US006889959B2

(12) United States Patent
Cholinski

(10) Patent No.: US 6,889,959 B2
(45) Date of Patent: May 10, 2005

(54) ACTUATING DEVICE FOR EMERGENCY OPERATION OF A GEARLESS DRIVE MACHINE OF AN ELEVATOR

(75) Inventor: Andrzej Cholinski, Ebikon (CH)

(73) Assignee: Inventio AG, Hergiswil (CH)

( * ) Notice: Subject to any disclaimer, the term of this patent is extended or adjusted under 35 U.S.C. 154(b) by 98 days.

(21) Appl. No.: 10/293,667

(22) Filed: Nov. 13, 2002

(65) Prior Publication Data

US 2003/0057028 A1 Mar. 27, 2003

Related U.S. Application Data

(63) Continuation of application No. PCT/CH01/00301, filed on May 16, 2001.

(30) Foreign Application Priority Data

May 19, 2000 (EP) ..... 00810440

(51) Int. Cl.[7] ..... B21F 9/00
(52) U.S. Cl. ..... 254/342; 187/263
(58) Field of Search ..... 254/342, 343, 254/359, 365, 388, 389; 187/263, 266, 254, 261, 350

(56) References Cited

U.S. PATENT DOCUMENTS 4,355,785 A 10/1982 Tosato et al.
5,148,893 A * 9/1992 Vertesy et al. ..... 254/362
5,819,876 A * 10/1998 Chao ..... 187/263
6,146,303 A 11/2000 Wittur et al.
6,478,124 B2 * 11/2002 Cholinski ..... 188/171
6,561,318 B1 * 5/2003 Lamb ..... 187/263

FOREIGN PATENT DOCUMENTS

EP 0 244 030 A1 11/1987
GB 2 083 292 A 3/1982

* cited by examiner

*Primary Examiner*—Emmanuel Marcelo
(74) *Attorney, Agent, or Firm*—Schweitzer Cornman Gross & Bondell LLP

(57) ABSTRACT

An actuating device for an elevator having a gearless drive having a motor, a traction sheave over which support ropes are passed and a motor braking device is in the form of a hand drive adapted to be engaged with the motor shaft for emergency elevator operation with a handwheel for manual motor shaft activation. The hard drive may include a gear coupling the handwheel and an output coupling in the form of a grooved hub. The braking device of the elevator is mounted to a pedistal having a cover with an opening through which the hub may be inserted to engage the motor shaft.

6 Claims, 4 Drawing Sheets

ACTUATING DEVICE FOR EMERGENCY OPERATION OF A GEARLESS DRIVE MACHINE OF AN ELEVATOR

The present invention is a continuation of PCT/CH01/00301, filed May 16, 2001.

The invention relates to a gearless drive machine of an elevator, comprising a motor, a traction sheave which is borne on a motor shaft and over which the ropes for supporting and moving an elevator car and a counterweight are passed, a braking device which is arranged on a bearing pedestal and serves to bring the motor to a standstill, and an actuating device for emergency operation by means of which the motor can be manually actuated.

BACKGROUND OF THE INVENTION

From patent specification EP 0 706 968 A2 a drive unit for an elevator has become known. The drive unit has passing through it a shaft which serves both as the shaft for a motor and a shaft for a gear. Arranged at one end of the shaft is a gear with a traction sheave for the elevator rope. Attached to the free, motor end of the shaft is a handwheel for emergency operation of the drive unit.

Fastened by pivoted joints to a baseplate are arms which carry brake shoes. By means of a cylinder, the brake shoes are pressed against the external circumference of a braking body.

A disadvantage of the known device is that the handwheel is situated close to the motor. When the handwheel is turned, fingers can easily be caught and trapped by the rotating handwheel. For emergency operation, the brake must be released at the same time as the handwheel is turned. Releasing the brake is made difficult by the brake being situated at one end of the motor and the handwheel at the other end.

In the case of gearless machines, the forces which must be overcome for emergency operation are substantially greater. To overcome them, it is common to use a gearbox with a handwheel, the gearbox being connected to the main shaft by means of a coupling device. Such equipment is expensive, awkward, and not without danger in operation.

BRIEF DESCRIPTIONS OF THE INVENTION

It is the foregoing disadvantages that the present invention sets out to remedy.

The invention comprises a gearless drive machine having a motor with a shaft that supports a traction sheave for elevator car and counterweight support ropes pass and braking device for the motor arranged on a bearing pedestal. An actuating device for emergency activation of the braking device comprises a hand drive unit which can be manually engaged with the motor shaft and has a handwheel which, when the hand drive unit is engaged with the motor shaft, allows the motor shaft to be manually turned. An interlock may be provided to insure that electrical power is not provided to the motor when the drive unit is engaged. The invention provides a solution to avoiding the disadvantages of the known device and creating a handwheel by means of which emergency operation of the elevator is trouble-free and safe.

The advantages achieved by the invention are essentially to be seen in that the hand drive can be mounted easily and without tools. When needed, the hand drive can be mounted on the drive machine. A coupling such as required with a permanently installed hand drive is no longer necessary. The safety of the persons performing the emergency operation is assured in all cases, since the electric drive is switched off automatically when the hand drive is mounted. Furthermore, in the case of an elevator installation with several elevators, it is sufficient for there to be one hand drive which can be used on whichever elevator requires emergency operation.

BRIEF DESCRIPTION OF THE DRAWINGS

The invention is described in greater detail below by the following description of an illustrative embodiment therein, in conjunction with the annexed drawings, wherein.

DETAILED DESCRIPTION OF THE INVENTION

Figure 1:
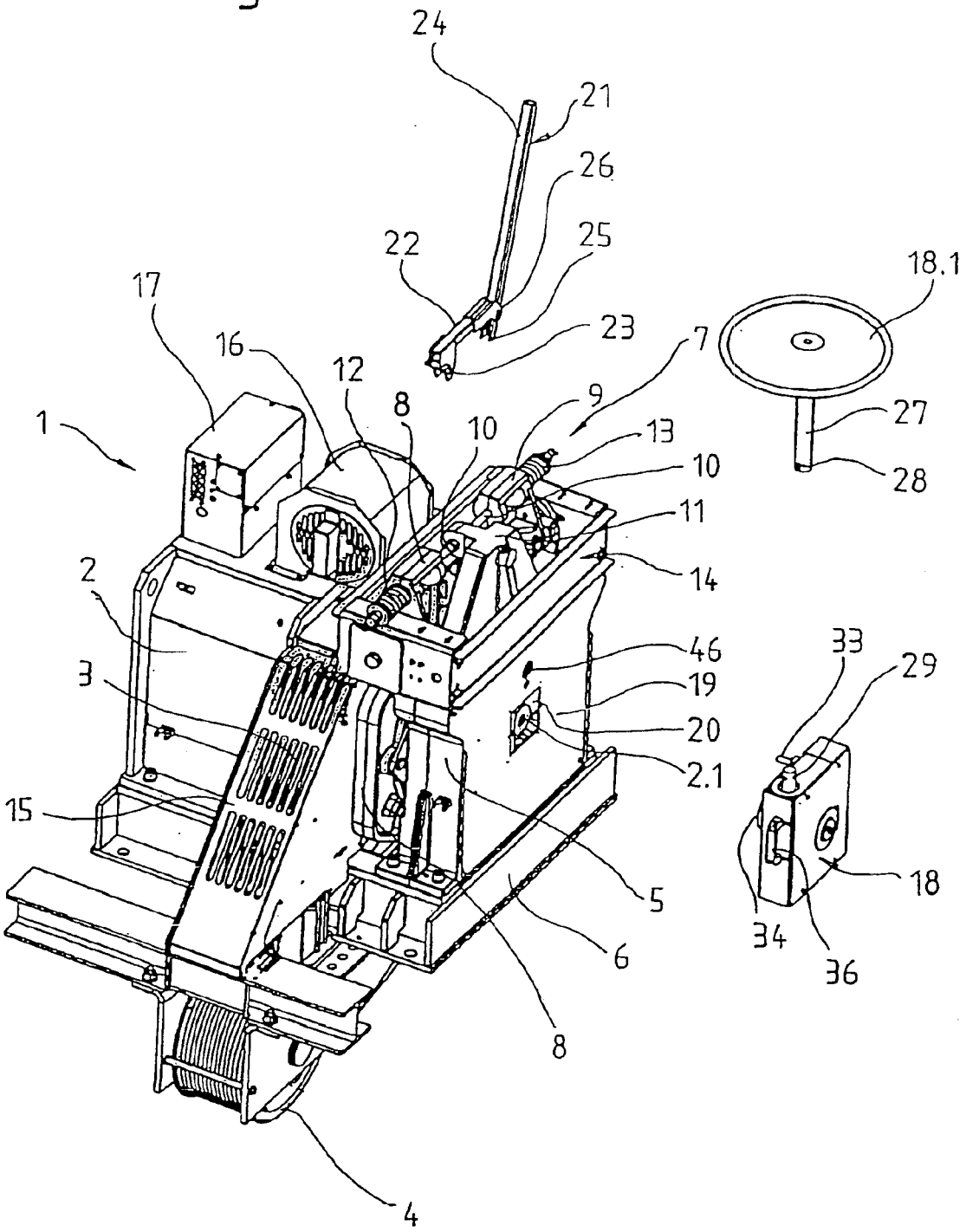
FIG. 1 depicts a drive machine of the invention with the hand drive and brake-release lever needed for emergency operation.

FIG. 1 shows a gearless drive machine 1 with a motor 2, comprising a stator and a rotor, which drives a traction sheave 3. Passing over the traction sheave 3 and a deflector sheave 4 are ropes (not shown) which support and drive an elevator car (not shown) and a counterweight (not shown). The traction sheave 3 is borne by a motor shaft 2.1 which is held in bearings located at one end in a bearing endplate (not shown) and located at the other end in a bearing pedestal 5. Motor 2, the endplate, bearing pedestal 5, and deflector sheave 4 are borne by a machine bracket 6.

The drive machine includes a braking device 7 with a first brake arm 8 and a second brake arm 9, on each of which arms a brake shoe is arranged. At their lower ends, the brake arms 8, 9 are pivoted on the bearing pedestal 5, and at their upper ends are guided by a rod 10. The rod 10 is arranged with its mid-point in a support 11 which is connected to the bearing pedestal 5. To actuate the brake shoes, each brake arm 8, 9 is provided with a respective compression spring 12, 13. To release the brake shoes each brake arm 8, 9 is provided with a magnet which acts against the compression spring. The magnets are arranged on a frame 14 which is connected to the bearing pedestal 5. A guard 15 covers the ropes between the traction sheave 3 and the deflector sheave 4. At the back of the drive machine 1, a further guard (not shown) covers the ropes between the traction sheave 3 and the machine bracket 6. To cool the drive unit 1, a ventilating fan 16 is provided. A terminal box 17 serves as interface for power supply cables and as an interface for control cables.

For emergency operation of the elevator, a hand drive 18 is provided which can be coupled with the motor shaft 2.1 without tools. A cover 19 of the bearing pedestal 5 has an opening 20 through which the hand drive 18 can be coupled to the motor shaft 2.1. The hand drive 18 can be driven by means of a handwheel 18.1. In case of an emergency, depending on how the elevator car is loaded the cap is moved manually in the upward or downward direction to the next stop and the passengers are evacuated. By turning the handwheel 18.1 and simultaneously releasing the brake shoes by means of a brake release lever 21, the motor shaft 2.1 is moved manually and the elevator car thereby lowered or raised. The brake release lever 21 consists of a yoke 22 with a first claw 23, and a handle 24 with a second claw 25, the yoke 22 being pivoted on a pivot point 26 15 of the handle 24. To release the brake shoes, more precisely the brake arms 8, 9, the brake release lever 21 is placed on the rod 10 and the handle 24 is moved forward, a force thereby acting through the claws 23, 25 on the brake arms 8, 9 against the spring force of the compression springs 12, 13, and releasing the brake shoes.

Figure 2:
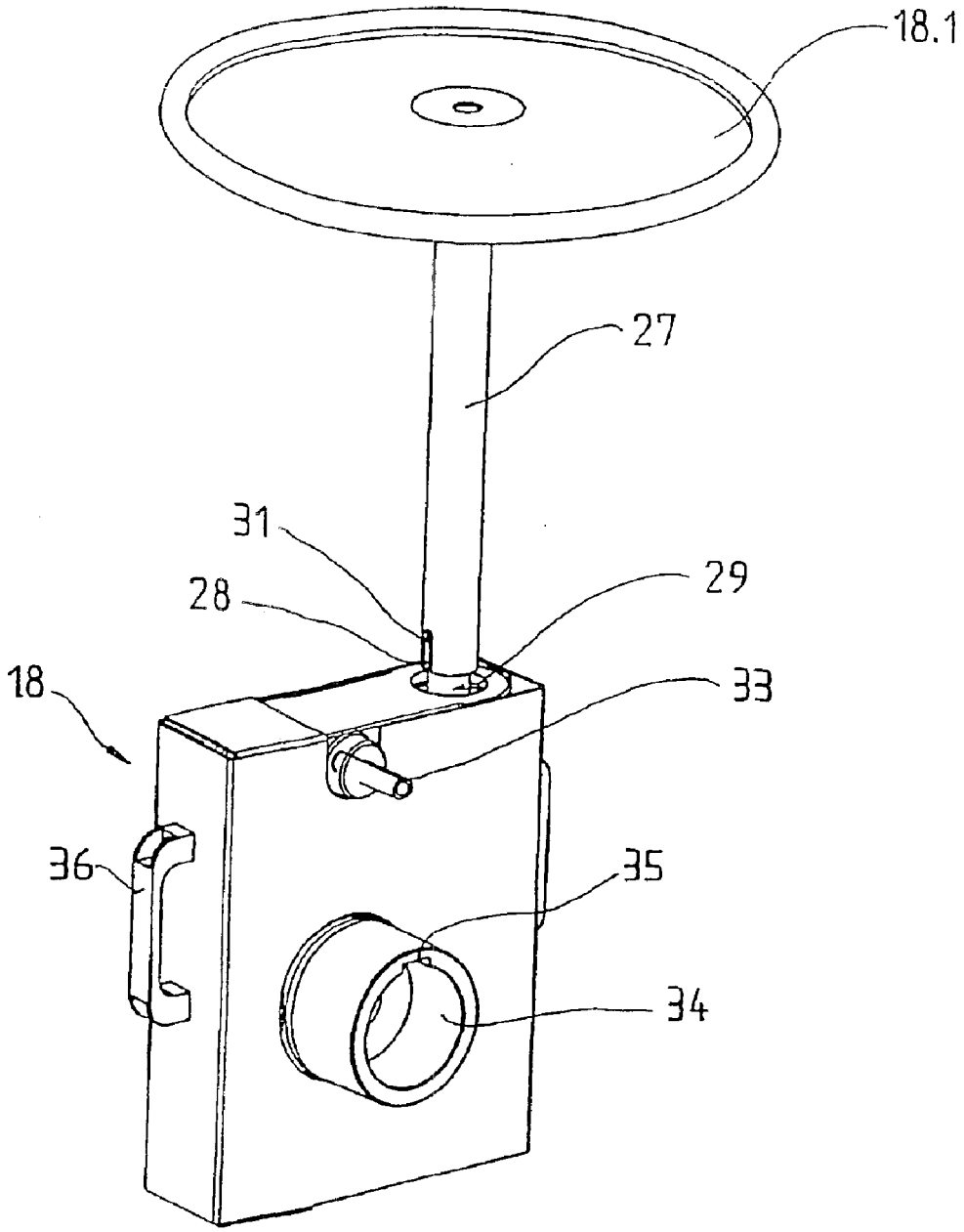
FIG. 2 depicts the hand drive with a handwheel.

FIG. 2 shows the hand drive 18 with handwheel 18.1 as viewed from the drive machine side. At the end of a hollow axle 27 of the handwheel 18.1 there is a slot 28. The hollow axle 27 can be pushed over an extension 29 of a worm shaft 30, a pin 31 of the extension 29 engaging in the slot 28 and thereby transmitting the rotational motion of the handwheel 18.1 to the worm shaft 30. A dowel 33 arranged on a housing 32 serves as a torque anchor. A hub 34 with a groove 35 can be pushed onto the motor shaft 2.1. Handgrips 36 facilitate mounting the hand drive 18 on the drive machine 1 and dismounting the hand drive 18 from the drive machine 1.

Figure 3:
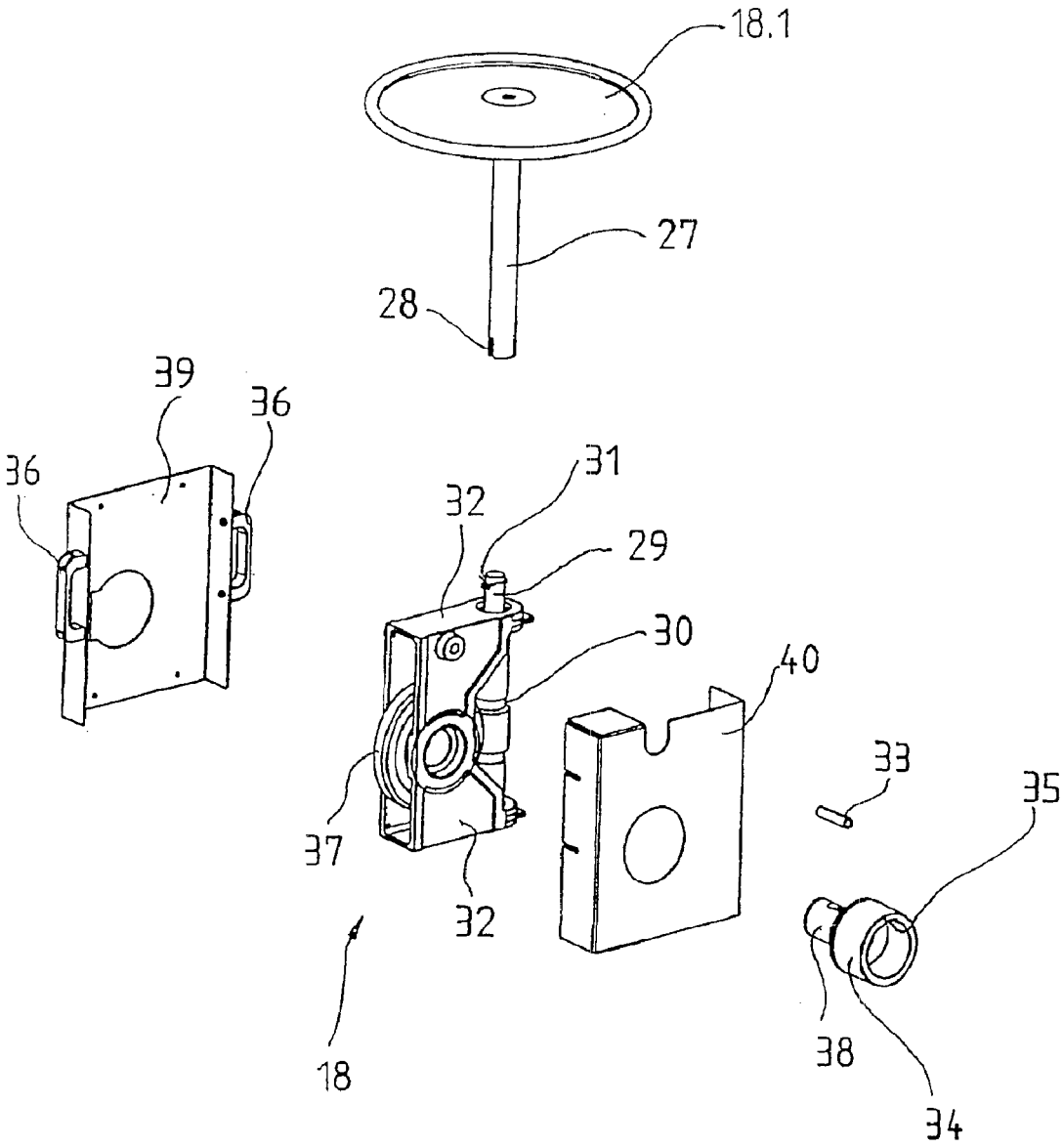
FIG. 3 is an exploded detail view of the hand drive.

FIG. 3 shows details of the hand drive 18. The worm shaft 30 drives a worm wheel 37, into which an extension 38 of the hub 34 is inserted. The extension 38 of the hub 34, and the worm shaft 30, are both held at both ends in bearings in the housing 32. A first wall 39 with the handgrips 36, and a second wall 40, enclose the housing 32. When the hand drive 18 is mounted on the drive machine 1, the hub 34 is pushed through the opening 20 of the cover 19 of the bearing pedestal 5 and onto the shaft end of the motor shaft 2.1. The groove 35 of the hub 34 fits over a key (not shown) on the motor shaft 2.1. By means of the groove/key connection, the rotational motion of the hub 34 is transmitted to the motor shaft 2.1. Worm shaft 30 and worm wheel 37 form a gear with handwheel 18.1 on the drive input side and with hub 34 serving as a coupling on the drive output side.

Figure 4:
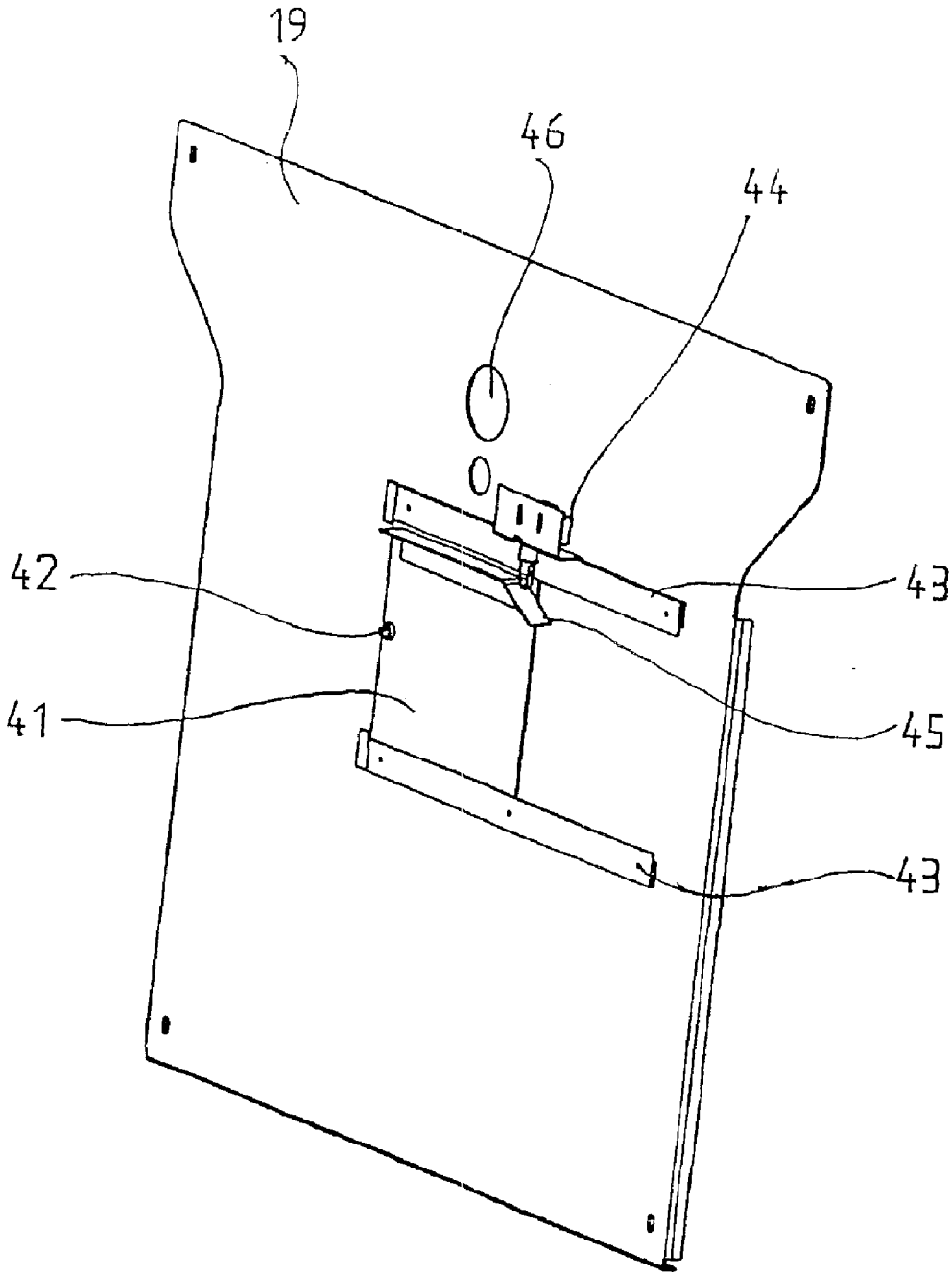
FIG. 4 depicts a cover of a bearing pedestal associated with the hand drive.

FIG. 4 shows an intemal view of the cover 19 which encloses the bearing pedestal 5. The cover 19 serves as guard for the shaft end of the motor shaft 2.1, and also allows simple mounting of the hand drive 19. The opening 20 of the cover 19 through which the hub 34 passes can be closed by means of a sliding panel 41 and a closing element 42. The sliding panel 41 is guided by guide rails 43. Arranged on the cover 19 to monitor the position of the sliding panel 41 there is a sensor 44, for example a microswitch, which can be actuated by means of a cam 45 arranged on the sliding panel 41. The sensor 44 prevents electrical operation of the drive machine 1 when the sliding panel 41 is open. With the handwheel 18.1 mounted, a hole 46 in the cover 19 receives the dowel 33. Dowel 33 and hole 46 from the torque anchor for the hand drive 18.

I claim:

1. A gearless drive machine for an elevator comprising a motor, a traction sheave which is borne on a motor shaft and over which ropes for supporting and moving an elevator car and a counterweight are passed, a motor braking device which is arranged on a bearing pedestal and an actuating device for emergency operation by means of which the motor shaft can be manually actuated, characterized in that the actuating device is a manually tool-free mountable and removable hand drive adapted to be engaged with the motor shaft and having a handwheel for manual actuation of the motor shaft.

2. The gearless drive machine according to claim 1, characterized in that the hand drive has a gear coupled on a drive input side to the handwheel and having on a drive output side a coupling to engage the motor shaft.

3. The gearless drive machine according to claim 2, characterized in that the coupling is a hub with a groove for transmitting the rotational motion of the handwheel to the motor shaft.

4. The gearless drive machine according to claim 3, characterized in that the bearing pedestal is enclosed by a cover which has an opening through which the hub of the mounted hand drive passes.

5. The gearless drive machine according to claim 4, characterized in that a sliding cover is arranged on the cover which during electrical operation of the motor closes the opening, and a sensor for monitoring the position of the sliding cover.

6. The gearless drive machine according to claim 4 or 5, characterized in that a hole is provided in the cover which when the hand drive is mounted forms, together with a dowel of the hand drive, a torque anchor for the hand drive.

* * * * *